US005078522A

United States Patent [19]

Nishizawa et al.

[11] Patent Number: 5,078,522

[45] Date of Patent: Jan. 7, 1992

[54] PRINTER FOR BAR-CODED PAPER

[75] Inventors: Yoshikazu Nishizawa; Kenji Suzuki, both of Shizuoka, Japan

[73] Assignee: Star Micronics Co., Ltd., Shizuoka, Japan

[21] Appl. No.: 515,122

[22] Filed: Apr. 27, 1990

[30] Foreign Application Priority Data

May 1, 1989 [JP] Japan ..... 1-112498

[51] Int. Cl.[5] ..... B41J 11/46

[52] U.S. Cl. ..... 400/583.3; 400/630; 400/711

[58] Field of Search ..... 400/630, 582, 703, 706, 400/706.1, 709, 711, 583.3, 639.1, 356

[56] References Cited

U.S. PATENT DOCUMENTS

| | | | |
|---|---|---|---|
| 4,025,025 | 5/1977 | Bartel et al. | 101/181 |
| 4,531,851 | 7/1985 | Kondo et al. | 400/708 |
| 4,699,531 | 10/1987 | Ulinski | 400/74 |
| 4,746,233 | 5/1988 | Garcia de Osuma | 400/73 |

FOREIGN PATENT DOCUMENTS

| | | | |
|---|---|---|---|
| 162092 | 10/1982 | Japan | 400/709.2 |
| 173684 | 10/1983 | Japan | 400/709.2 |
| 229768 | 11/1985 | Japan | 400/709 |
| 259857 | 11/1987 | Japan | 400/583.3 |

*Primary Examiner*—Edgar S. Burr
*Assistant Examiner*—Joseph R. Keating
*Attorney, Agent, or Firm*—Koda and Androlia

[57] ABSTRACT

A printer having a function of reading a bar code attached on a printing paper. A carrier cover of a sensor carrier unit is disposed against the bar-coded surface of the printing paper as located in the printing position by a positioning means, and the printing paper is supported on its rear surface by a guide member, whereupon the sensor carrier unit is moved in the direction of reading the bar code. Therefore, the distance between the bar code and the sensor is normally kept constant so that the printing paper is effectively prevented from being displaced during reading.

5 Claims, 8 Drawing Sheets

PRINTER FOR BAR-CODED PAPER

BACKGROUND OF THE INVENTION

1. Field of the Invention

This invention relates to a line thermal printer for a bar-coded paper, and more particularly to such line thermal printer in which printing conditions can be automatically set in conformity with the size of a printing medium which size is optionally selected from a plurality of sizes.

2. Description of the Related Art

For papers as printing media, there are various sizes and forms, such as sheets of paper cut into regular sizes of A4, B5, B4, etc. and continuous sheets of paper having separating lines of perforations.

Heretofore, in printing with these printing papers, it is required to adjust the printing position and range of the printer in conformity with the size and form of the individual printing paper. In order not to perform printing outside the printing paper or over the separating lines of perforations, the width and length of printing are inputted to the printer by a suitable means to thereby set an appropriate printing area before printing.

In a thermal transfer printer using a dot-type thermal head, the head is heated directly by a built-in heater during printing. Some of such thermal transfer printers use a thermal paper (thermosensitive paper) coloring by heat, and in some of the thermal transfer printers, ink of a ribbon is melted by the heat of the head and is transferred to the print paper, and others use a thermal transfer paper composed of an inked paper and a substrate as a printing medium. It is required to set appropriate printing conditions such as by changing the driving condition of the head to meet the quality of a printing paper, such as by varying the conducting width in accordance with the thermosensitive characteristic, which depends on the color of ink, when printing by a thermal head, and by varying the conducting width to meet the quality of a thermal transfer paper when the thermal transfer paper uses a substrate. Practically, however, performing these procedures manually is laborious and time-consuming.

To this end, for automating the setting of these printing conditions, an attempt has hitherto been made to attach to a printing medium a label bearing a bar code or to print a bar code directly on a printing medium; the bar code presents information about the printing conditions. In use, with the bar-coded paper loaded on a printer, a sensor carrier unit, which has a built-in light-reflecting sensor composed of a light emitting element and a light receiving element, is located in confronting relation with the bar code to read the printing conditions as the sensor carrier unit is moved along the bar code. With this conventional arrangement, since printing is performed in accordance with the printing conditions that are automatically inputted to meet the individual printing paper, accurate printing can be achieved efficiently without the burden of manual setting of the printing conditions. This prior art is exemplified by Japanese Patent Laid-Open Publication No. 271189/1987.

Specifically, as the sensor carrier unit is moved along the bar coded portion of the printing paper, light emitted from the light emitting element of the sensor built in the sensor carrier unit strikes on the bar code and is then reflected to direct to the light receiving element which converts the received light to an electrical signal. At that time, the light source of the light emitting element may be a laser, which generates a very narrow, intense beam of coherent light, to achieve reliable reading irrespective of the distance between the light source and the bar code; but a problem is that a laser is relatively expensive.

For low cost and compact size, a light-reflecting sensor composed of an light-emitting diode and a photo-transistor is recently coming to be widely used. However, since light of the light-emitting diode can easily diffuse, the photo-transistor cannot accurately receive the diode's light reflected on the bar code, if the sensor comes out of a predetermined allowable positional range matching a required sensor characteristic as the sensor is located too remotely from the bar code or as the bar code floats in part off the paper. This causes only inaccurate reading.

So attempts have been made to keep the distance between the sensor and the bar code by improving the precision of individual components of the reader mechanism, but they have been found unsatisfactory due the staggering quality and assembly of the individual components and also due to the increase of cost of the parts and hence of production.

Another problem with the prior printer is that in the absence of any means for holding the paper in position during reading, the paper can easily be deflected from the correct position relative to the sensor in response to even a slight vibration or impact.

SUMMARY OF THE INVENTION

It is therefore an object of this invention to provide a line thermal printer, for making a print on a bar-coded paper, in which printer reading of the bar code can be performed accurately, even with the staggering distance between the bar code and a light-reflecting sensor due to puckering of the bar coded portion, and free of printing trouble even in the absence of a certain vibration or impact exerted on the printer body.

According to this invention, there is provided a printer for bar-coded papers, comprising: positioning means for fixedly positioning a printing medium to which a bar code is attached; a sensor carrier unit engageable with the bar-coded surface of the fixedly positioned printing medium for reading the bar code on the printing medium, the sensor carrier unit including a carrier base, a carrier cover vertically movable on the carrier base, a light-reflecting sensor fixed to the carrier cover, and a sensor spring normally urging the carrier cover toward the bar-coded surface of the printing medium; a paper guide fixed to a frame for retracting the sensor carrier unit from the printing medium; a guide member for supporting the printing medium on a rear surface opposite to the bar-coded surface that is engaged by the sensor carrier unit; and a sensor-carrier-unit drive mechanism for moving the sensor carrier unit in a direction of reading the bar code on the printing medium.

With this arrangement, since at least one of the thermal head and the platen is pivotally movable between a printing position in which the thermal head and the platen are located close to each other to hold therebetween the printing medium and a non-printing position in which the thermal head and the platen are located remotely from each other to release the printing medium, the printing medium can be loaded on the platen at the non-printing position and can be held in position at the printing position, i.e., during reading the bar code. Therefore the printing medium is hardly displaced, even when received a vibration or impact, during reading the bar code.

Further, partly since at least one of the sensor carrier unit and the guide member is movable, in response to the movement of the line thermal printer mechanism, between a reading position in which it is in contact with the printing medium and a non-reading position in which it is retracted from the printing medium, and partly since the sensor carrier unit is movable along the bar code, the bar code can be read accurately and easily as the distance between the sensor and the bar code is corrected if it varies due to puckering of the bar-coded portion.

The above and other advantages, features and additional objects of this invention will be manifest to those versed in the art upon making reference to the following detailed description and the accompanying drawings in which a preferred structural embodiment incorporating the principles of this invention is shown by way of illustrative example.

The principles of this invention are particularly useful when embodied in a line thermal printer, for a bar-coded paper, such as shown in FIGS. 1 through 4. In the illustrated embodiment, a printing medium is a bar-coded thermal transfer paper as described below in connection with FIG. 9.

(Line Thermal Printer Mechanism)

In the line thermal printer, an array of heaters is built in a dot-type printer head for performing printing line by line. Since printing is conducted with the head in contact with a printing medium, the printing medium can be kept stationary in a printing position.

Figure 9:
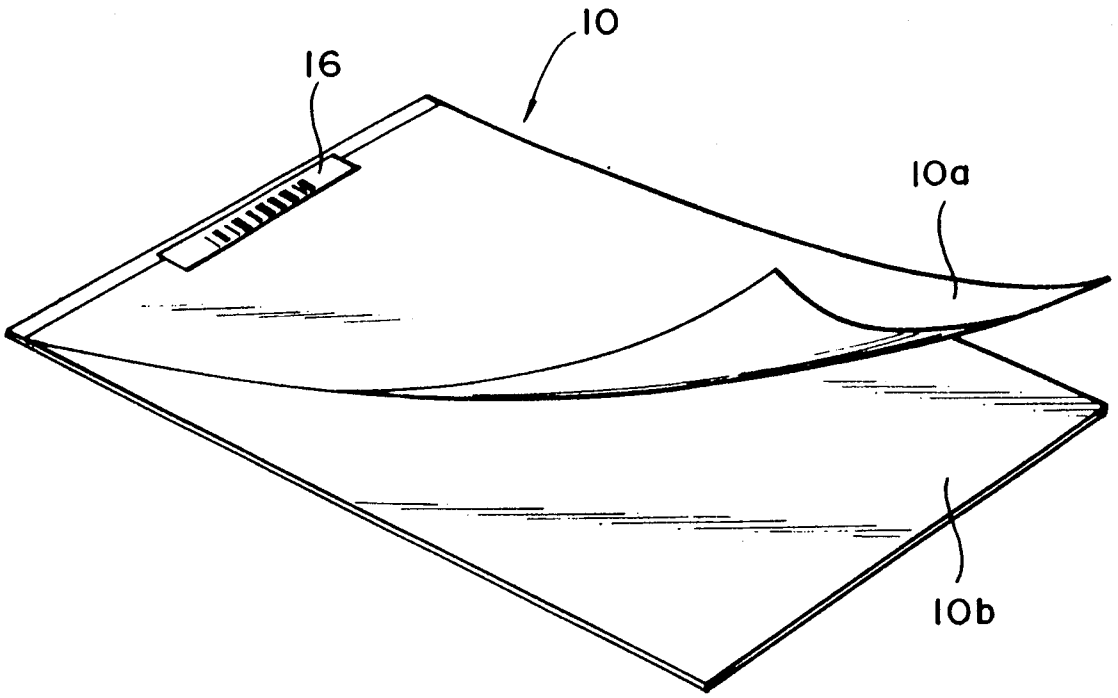
FIG. 9 is a perspective view of a ground-boarded thermal transfer paper.

As shown in FIG. 9, the printing medium is a thermal transfer paper 10 which is composed of an inked sheet 10*a*, and a ground board 10*b* onto which the ink is transferred from the inked sheet 10*a* to form a print. The ground board 10*b* is separably attached at its upper marginal portion to the inked sheet 10*a*. A label bearing a bar code 16 is attached to an upper marginal portion of the inked sheet 10*a*; alternatively the bar code 16 may be printed directly on the inked sheet 10*a*. The bar code 16 represents a set of printing conditions.

Figure 1:
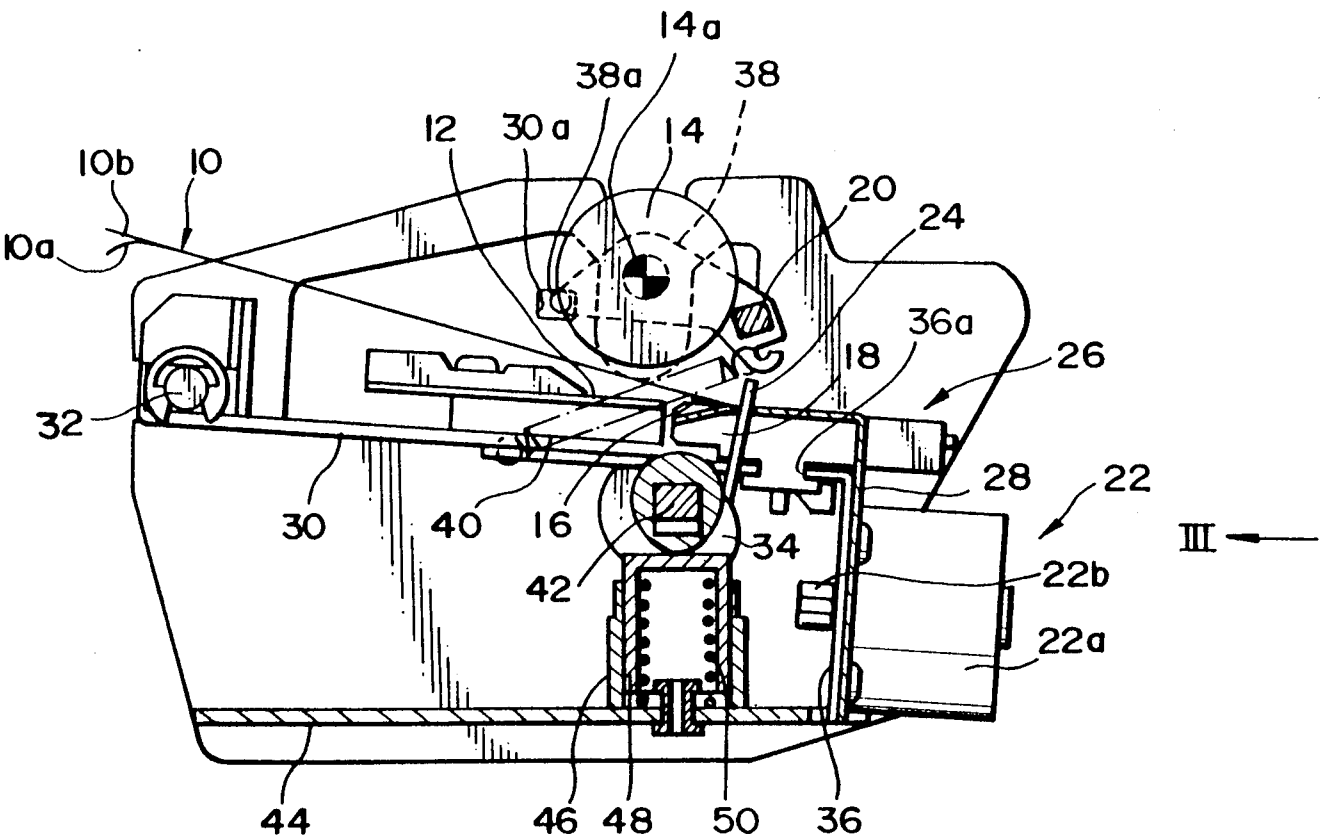
FIG. 1 is a cross-sectional view of a line thermal printer embodying this invention, showing the printer in a non-printing position where a line thermal head is released.

As shown in FIG. 1, a line thermal head 12 is fixed to a head holder 30 pivotally supported on a pivot 32. Before setting or loading the printing medium 10, a release cam 34 is lowered, and the line thermal head 12 is located in a non-printing position remote from the platen 14.

For reading the bar code, a light-reflecting sensor 18 is built in a sensor carrier unit 26 which is pivotally supported on a distal end of the head holder 30. The sensor 18 is composed of a light-emitting diode and a photo-transistor. The sensor carrier unit 26 is movable along a slit 36*a* of a sensor frame 36 in the direction of reading the bar code 16, i.e., rightwardly in FIGS. 3 and 4 as driven by a bar-code motor 22*a*.

A guide member 20 is in the form of a rod located so as to support the printing medium 10 on its rear surface at a position corresponding to the bar code 16. The guide member 20 should by no means be limited to this specific example and may be any other form for supporting the bar-coded portion from the rear side of the printing medium 10. The guide member 20 is fixed to a bail lever 38 which is pivotable about a shaft 14*a* of a platen 14, and is located aside upwardly while the head holder 30 is in the nonprinting position. Namely, since a bail pin 38*a* on a distal end of one arm of the bail lever 38 is freely movably engaged in a rectangular hole 30*a* of the head holder 30, the bail lever 38 is pivotally moved counterclockwise to move the guide member 20 upwardly against the bias of a tension spring 40 when the head holder 30 is lowered.

In this state, the thermal transfer paper is set or loaded by a manual or automatic paper supply unit from the leftside in FIG. 1 in such a manner that the printing surface (i.e., the bar-coded surface) of the paper is disposed at the side of the line thermal head 12. At that time, the printing medium 10 is inserted over a paper guide 28 until its leading end portion reaches a paper stop 24.

As a cam shaft 42 is turned through an angle of 180° by a non-illustrated release motor, a release cam 34 presses the line thermal head 12 against the platen 14 via the paper 10. This is the printing position shown in FIG. 2.

A spring holder guide 46 is fixed to a base frame 44. Inside the spring holder guide 46, a spring holder 48 is vertically movably disposed in contact with the inner wall of the spring holder guide 46, and a head pressure spring 50 is received in the spring holder 48 and normally urges the spring holder 48 to a predetermined position. Thus the spring holder 48 is resiliently held in this position. By this resilient mechanism located on the opposite side of the head holder 30 with the cam 34 disposed therebetween, it is possible to release a lateral pressure acting on the cam shaft 42 when the line thermal head 12 is pressed against the platen 14.

In the illustrated embodiment, the cam shaft 42 has a square cross section, and the release cam 34 has a slightly vertically elongated rectangular hole so that the cam shaft 42 can be vertically moved in the rectangular hole to a slight extent. As a result, most of the biasing force of the head pressure spring 50 can be transmitted to the line thermal head 12 via release cam 34, without acting on the cam shaft 42, so that the lateral pressure acting on the cam shaft 42 can be released to eliminate any deformation and damage.

Figure 2:
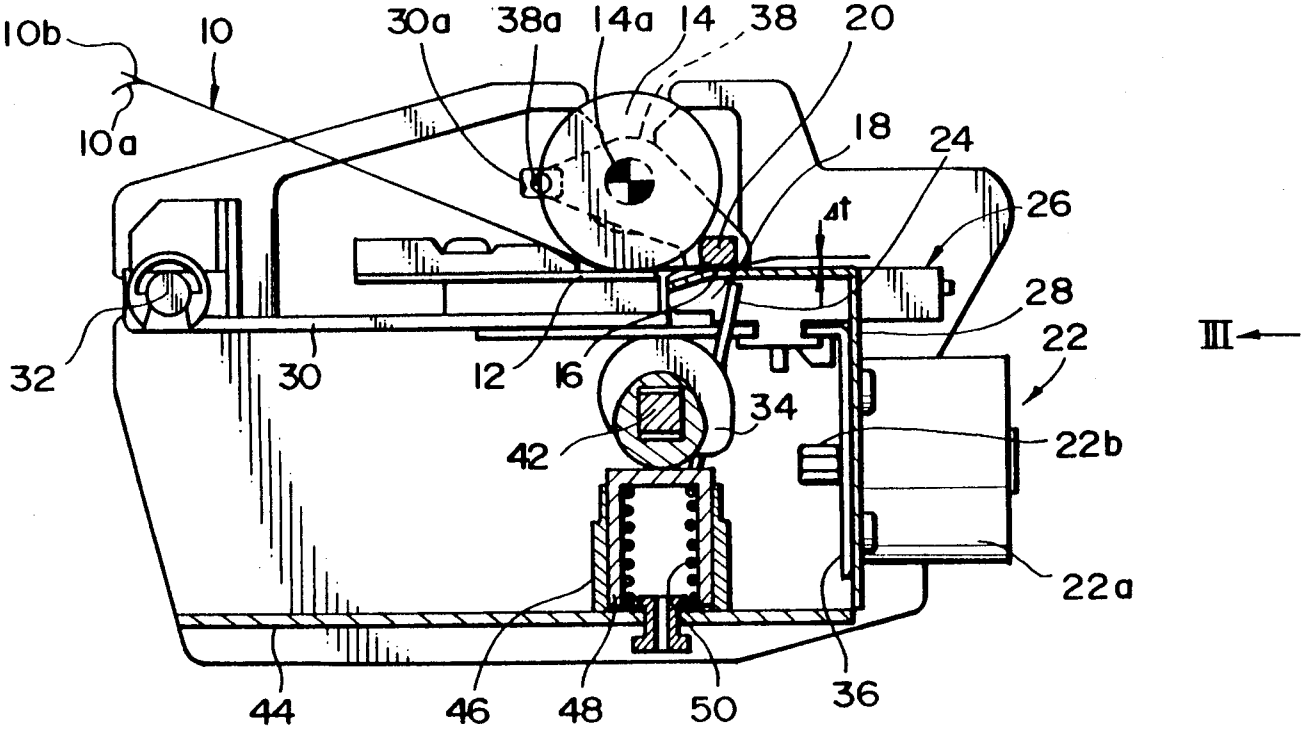
FIG. 2 is a view similar to FIG. 1, showing the printer in a printing position where the line thermal head is disposed against a platen.

With the rising of the head holder 30 as a unit with the line thermal head 12, the rectangular hole 30*a* brings the bail pin 38*a* upwardly to cause the bail lever 38 to pivotally move clockwise so that the guide member 20 is lowered to a predetermined position shown in FIG. 2. While the line thermal head 12 is located remotely from the platen, the guide member 20 also is remote from the line thermal head 12. Therefore the head can be cleaned with ease. Alternatively the guide member 20 could be fixed in the position of FIG. 2 from the beginning.

Since the printing medium 10 is held in the printing position in which it is sandwiched between the platen 14 and the line thermal head 12, the printing medium 10 would not be displaced even as received a slight vibration or impact, preventing any reading error.

From the position of FIG. 2, reading of the bar code is conducted as described below, and the line thermal head 12 performs printing on the printing medium 10 line by line by thermal transfer in accordance with the printing conditions as read.

(Bar Code reader mechanism)

By the above-mentioned series of operation procedures, as shown in FIG. 2, the bar-coded portion (16) of the printing medium 10 is located within a gap Δt between the guide member 20 and the paper guide 28. This Δt is preferably a gap corresponding to the thickness of about one or two printing mediums so that a printing medium can be held almost exactly. Consequently even if the bar-coded surface is puckering or if the parts precision of the bar code reader mechanism is not so high, it is possible to keep the distance between the built-in sensor 18 of the sensor carrier unit 26 constant with ease.

For moving the sensor carrier unit 26 to a predetermined home position (hereinafter called "H. P.") of FIG. 3, in which an H. P. switch 52 is located, when conducting to a power source, the bar code motor **22*a* is rotated to move a carrier rope 22*b* via a pinion 22*b* and a pulley gear 22*g*. The carrier rope 22*e* has a carrier spring 22*f* giving a tension to the carrier rope 22*e* so that the rotational force of the pulley gear 22*g* is transmitted to the carrier rope 22*e* without fail. The carrier rope 22*e* is wound at opposite ends about a pair of pulleys 22*c*, 22*d*. The H. P. switch 52 causes the sensor 18 to take an ON state when the sensor carrier unit 26 reaches the H. P., and to take an OFF state when the sensor carrier unit 26** is located at any other position.

Figure 8:
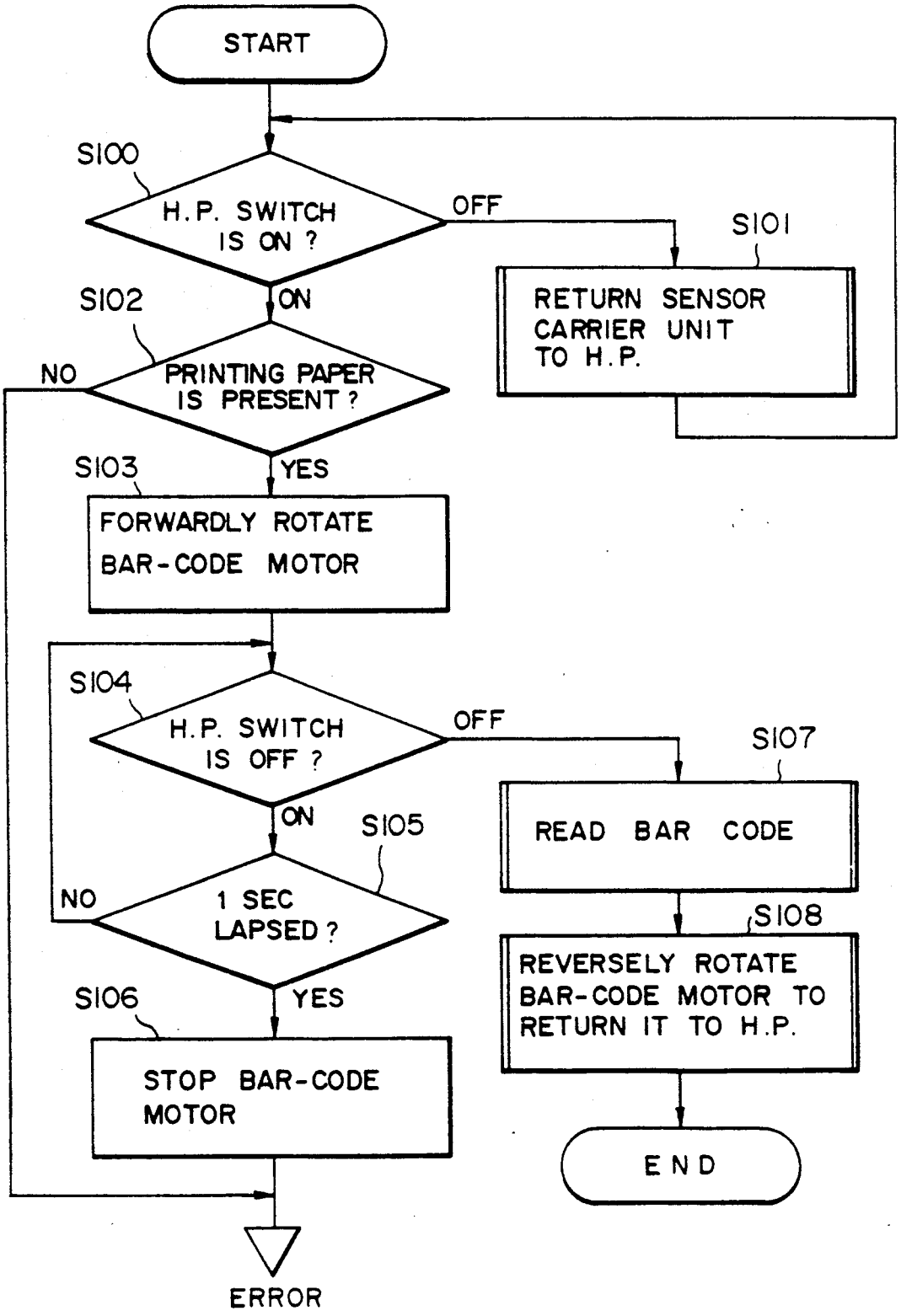
FIG. 8 is a flowchart showing the manner in which a bar code is read.

The operation of the bar code reader mechanism will now be described in connection with FIGS. 3, 4 and 8.

Starting the procedures from the state shown in FIG. 2, at step 100, checking is performed whether the H. P. switch 52 assumes the ON state or not, namely, whether the sensor carrier unit 26 is located in the H. P.

If the H. P. switch 52 assumes the OFF state, the routine goes to step 101 where the bar code motor **22*a* is rotated to return the sensor carrier unit 26 to the H. P. of FIG. 3 temporarily, making a check again at step 100**.

If the H. P. switch 52 assumes the ON state, the routine goes to step 102 to check whether the printing paper is present or absent. This checking is performed by a non-illustrated paper detection sensor located near the paper stop of FIG. 2. In the absence of a printing paper, an error is displayed.

Figure 3:
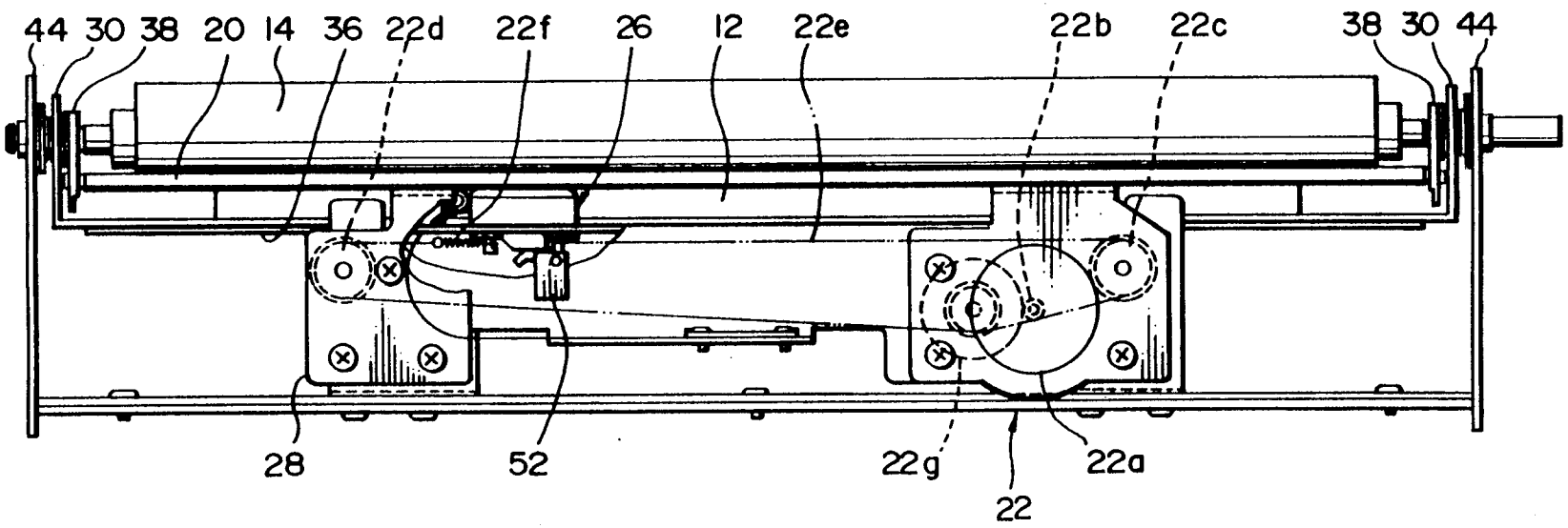
FIG. 3 is a front elevational view of the printer.
Figure 4:
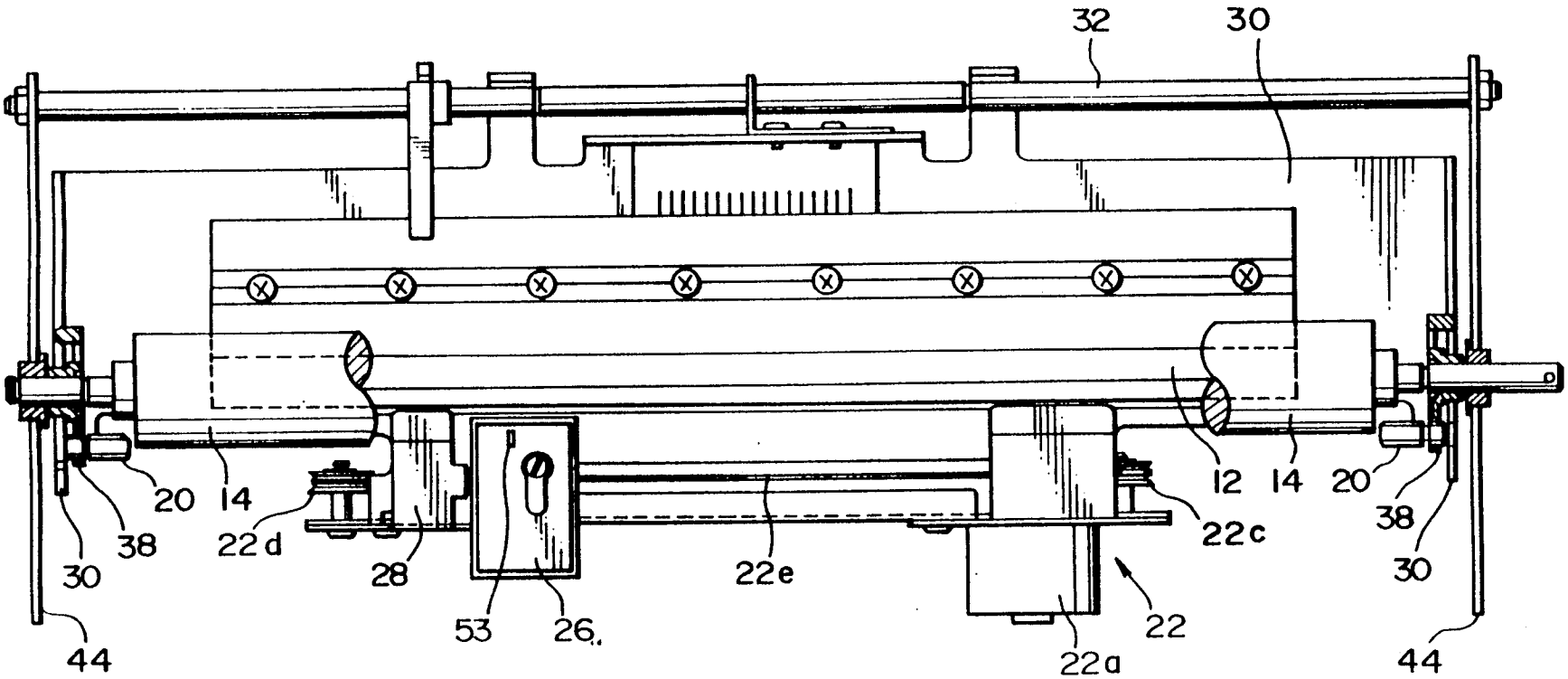
FIG. 4 is a plan view of the printer.

In the presence of a printing paper, the routine goes to step 103 where the bar code motor **22*e* is rotated forwardly so as to move the sensor carrier unit 26 in the direction of reading the bar code (rightwardly in FIG. 3**).

At step 104, as the sensor carrier unit 26 is moved rightwardly, the H. P. switch 52 assumes the OFF state. If the H. P. switch 52 still remains the ON state, the bar code motor **22*a* is stopped to display an error at step 106 unless the H. P. switch 52 comes to take the OFF state before lapsing one second at step 105**.

When the H. P. switch 52 has come to take the OFF state at step 104, the sensor carrier unit 26 is moved off the H. P. and runs in the direction of reading the bar code. The light-emitting diode of the sensor carrier unit 26 of FIG. 4, which is a plan view of FIG. 3, emits light to strike the bar code, and then the light is reflected on the bar code to enter a read slit 53, whereupon the light is received by the photo-transistor to thereby read the bar (step 107). At that time, the light-reflecting sensor 18 has to be moved at constant speed to read a variety of widths of bars of the bar code; for this purpose, the illustrated embodiment employs a non-illustrated governor circuit which controls the bar code motor **22*a*** to a constant speed of rotation.

Upon completion of reading, the routine goes to step 108 where the bar code motor **22*a* is reversely rotated so that the sensor carrier unit 26** is returned to the H. P. to thus terminate reading of the bar code.

With the bar code reader mechanism of the illustrated embodiment, partly since the printing medium 10 is held from its rear side by the guide member 20 during reading, and partly since the light-reflecting sensor is disposed close to or against the printing medium 10 during reading, it is possible to read the bar code precisely, despite using the light-reflecting sensor which is composed of a light-emitting diode and a photo-transistor. Accordingly the line thermal printer of this invention is inexpensive and small-sized.

(Sensor Carrier Unit)

The structure and operation of the sensor carrier unit 26 will now be described in greater detail in connection with FIGS. 5 through 7.

Figure 5:
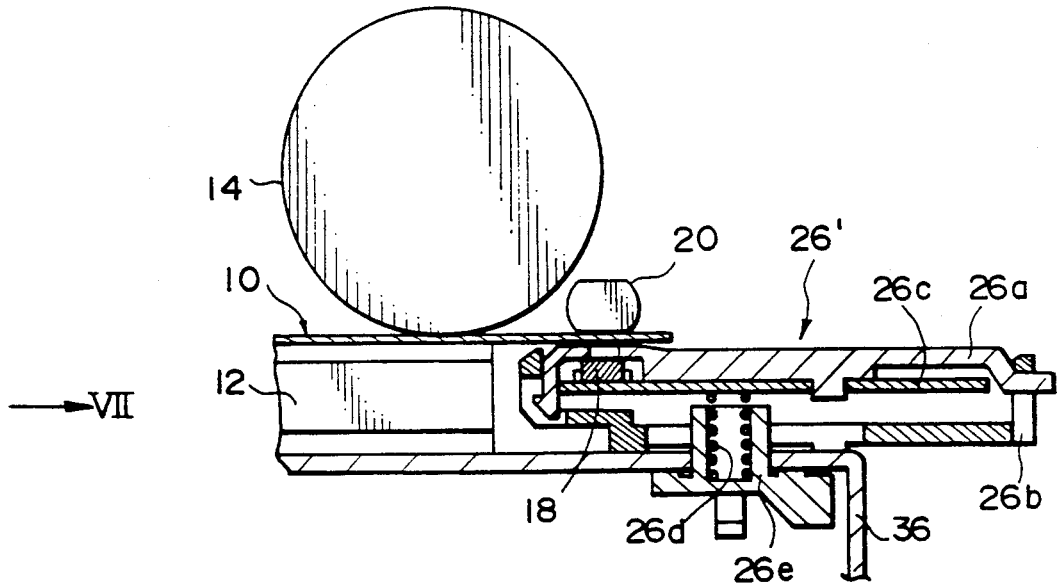
FIG. 5 is a cross-sectional view taken along line V—V of FIG. 7, showing a sensor carrier unit located in the H. P.

In the interior of the sensor carrier unit 26' which is moved by the unit driving mechanism 22 in the direction of reading the bar code, as shown in FIG. 5, the light-reflecting sensor 18 is fixed on a print-wired sensor board **26*c* pivotally mounted on a carrier cover 26*a*. The carrier cover 26*a* is vertically pivotally supported on the carrier base 26*b* and is normally urged upwardly by a sensor spring 26*d* fixed to the carrier base 26*b*. A projection 26*e* extending downwardly from the carrier base 26*b* is received in a slit formed in a sensor frame 36, the slit extending perpendicularly to the plane of sheet of the drawing. Thus the sensor carrier unit 26 is movable along the slit in the direction of reading the bar code. FIG. 5 is a cross-sectional view of the sensor carrier unit 26'** located in the H. P.

Figure 6:
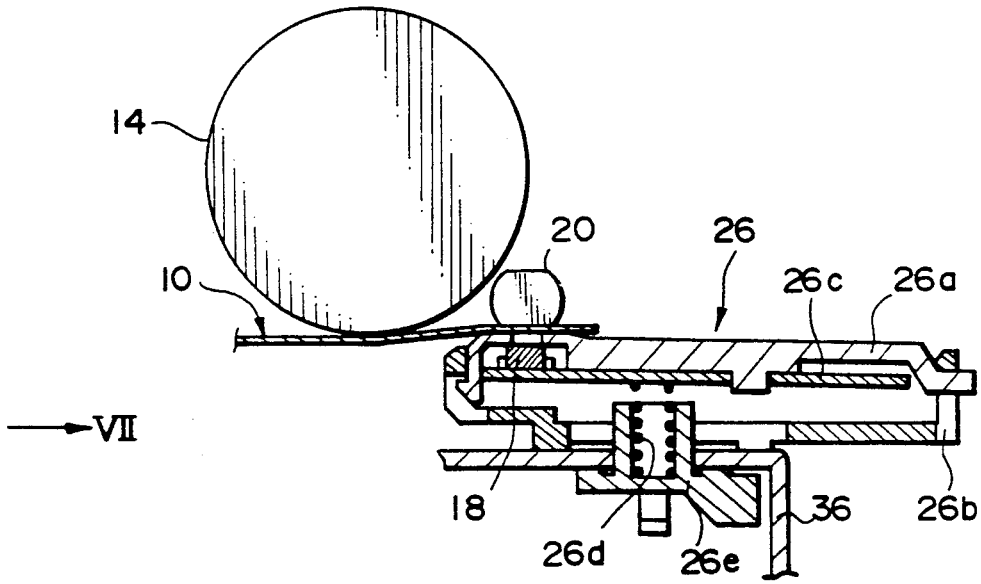
FIG. 6 is a cross-sectional view taken along line VI—VI of FIG. 7, showing the sensor carrier unit located in a bar code reading position.

FIG. 6 is a view similar to FIG. 5, showing the sensor carrier unit 26' having been moved from the H. P. to the bar code reading position. In FIG. 6, unlike FIG. 5, the carrier cover **26*a* is released from the H. P. where the carrier cover 26*a* is pressed downwardly by the paper guide 28 (FIG. 7). The carrier cover 26*a* is then urged upwardly against the bar-coded surface of the printing medium 10 by the carrier spring 26*d***.

Figure 7:
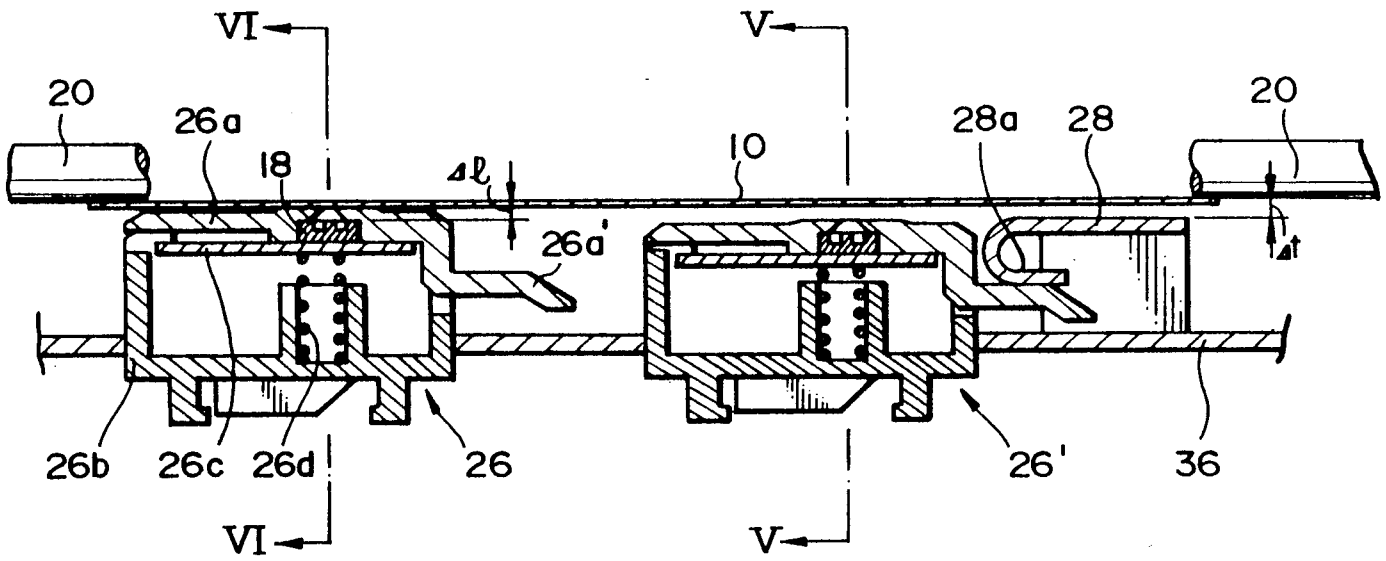
FIG. 7 is a rear cross-sectional view of the sensor carrier unit.

FIG. 7 is a hypothetical combined cross-sectional view as viewed from the direction of respective arrows VII in FIGS. 5 and 6. The sensor carrier unit 26 illustrated at the left side of FIG. 7 assumes the bar code reading position (FIG. 6); with the printing medium 10 supported on its rear surface by the guide member 20, the sensor carrier unit is disposed resiliently against the bar-coded surface so that the light-reflecting sensor 18 can read the bar code as the sensor carrier unit moves in the reading direction. The carrier cover 26*a* has an angled claw 26*a* extending horizontally from its right end.

With the sensor carrier unit 26' located in the H. P. illustrated at the right side in FIG. 7, the claw 26*a'* is brought downwardly by the engagement with a bent strip 28*a* of the paper guide 28 to thereby be held in its lower position against the bias of the carrier spring 26*d*. As a result, the sensor carrier unit 26' is moved away from the printing medium 10 to prevent the leading end portion of the printing medium 10 from being caught during setting or loading the printing medium 10. Thus the sensor carrier unit is normally located at the H. P. standby during setting the printing medium 10.

When a fresh printing medium 10 is inserted, the sensor carrier unit 26' is moved leftwardly so that the claw 26*a'* is removed from the paper guide 28. This allows the carrier cover 26*a* and the sensor 18 to be pressed against the printing medium 10 under the biasing force of the sensor spring 26*d* built in the sensor carrier unit 26. At that time, the distance between the sensor 18 and the bar-coded surface is maintained to a constant value Δl. Consequently, it is possible to read the bar code comfortably and accurately by using the light-reflecting sensor which is composed of a light-emitting diode and a phototransistor, guaranteeing an inexpensive small-sized printer.

With the line thermal printer of the illustrated embodiment, the line thermal held is pivotally movable between a non-printing position where a printing medium can be inserted with ease, and a printing position where the printing medium is held between the line thermal head and the platen, the printing medium can be prevented from being displaced when received a vibration or impact during reading. Thus it is possible to avoid inaccurate reading of the bar code.

Further, the sensor carrier unit and the guide member are movable, in response to the movement of the line thermal head, between a reading position where they are in contact with the printing medium, and a non-reading position wherein they are retracted from the printing medium. It is thereby possible to correct the distance between the bar-coded surface of the light-reflecting sensor as the distance is out of a required constant range.

According to the line thermal printer of this invention, even if the distance between the bar-coded surface and the sensor is not constant due to puckering of the bar-coded portion, the printing medium is supported on its rear surface opposite to the bar-coded surface by the guide member to correct the distance to a constant value. Therefore easy and precise reading of the bar code can be achieved without increasing the precision of the individual parts of the bar code reader mechanism.

Additionally, since the printing medium is held exactly between the line thermal head and the platen during reading of the bar code, the positional relation between the sensor and the bar code can be maintained even when a certain vibration or impact is exerted on the printing medium and the printer body.

What is claimed is:

1. A printer for bar-coded papers comprising:

(a) positioning means for fixedly positioning a printing medium to which a bar code is attached;

(b) a sensor carrier means engageable with a bar-coded surface of the fixedly positioned printing medium for reading the bar code on the printing medium, said sensor carrier means comprising a carrier base, a carrier cover vertically movable on said carrier base, a light-reflecting sensor fixed to said carrier cover, and a sensor spring means normally urging said carrier cover toward the bar-coded surface of the printing medium;

(c) a paper guide means fixed to a frame for retracting said sensor carrier unit from the printing medium;

(d) a guide means for supporting the printing medium on a rear surface opposite to the bar-coded surface that is engaged by said sensor carrier means; and (e) a sensor-carrier-unit drive means for moving said carrier means in a direction of reading the bar code on the printing medium.

2. A printer according to claim 1, in which said paper guide means has a bent strip adjacent to said sensor carrier means, and said carrier cover of said sensor carrier means has a claw engageable with said bent strip so as to retract said sensor carrier means from the bar-coded surface.

3. A printer according to claim 1, in which said sensor-carrier-unit drive means includes:

a bar code motor means for moving said sensor carrier means to a home position when connected to a power source;

a pinion coaxially fixed to a shaft of said bar code motor means;

a pulley gear meshing said pinion;

a carrier rope means connected at opposite ends to form a ring for transmitting a driving force of said bar code motor means to said sensor carrier means;

a carrier spring means disposed between the opposite ends of said carrier rope for normally applying a tension to said carrier rope; and a pair of pulleys supporting said carrier rope means for rotation.

4. A printer according to claim 1, further including a home position switch which assumes an ON state when said sensor carrier unit is positioned in the home position.

5. A printer according to claim 1, in which said frame has a slit extending in the direction of reading the bar code, and said carrier base has a projection extending downwardly and received in said slit, said sensor carrier means being thereby movable along said slit.

* * * * *